United States Patent [19]

Henning

[11] Patent Number: 4,716,970

[45] Date of Patent: Jan. 5, 1988

[54] OIL OR GAS WELL WORKOVER TECHNIQUE

[76] Inventor: Freddie L. Henning, P.O. Box 434, Goliad, Tex. 77963

[21] Appl. No.: 909,919

[22] Filed: Sep. 22, 1986

[51] Int. Cl.[4] ..... E21B 43/00

[52] U.S. Cl. ..... 166/372; 166/298; 166/386

[58] Field of Search ..... 166/68, 105, 106, 297, 166/298, 369, 370, 372, 382, 386, 72, 387, 55, 55.1, 55.2, 325, ; 417/54, 76, 197, 172, 360

[56] References Cited

U.S. PATENT DOCUMENTS

| | | | |
|---|---|---|---|
| 2,212,044 | 8/1940 | Ridley | 166/297 |
| 2,540,122 | 2/1951 | Kinley | 166/55.1 |
| 2,544,601 | 3/1951 | Kinley | 166/55.1 |
| 3,642,070 | 2/1972 | Taylor et al. | 166/297 |
| 3,789,923 | 2/1974 | Garrett | 166/297 |
| 3,887,008 | 6/1975 | Canfield | 166/372 |
| 4,237,976 | 12/1980 | Wilson | 166/369 |
| 4,441,861 | 4/1984 | Canalizo | 417/54 |
| 4,504,195 | 3/1985 | Binks et al. | 417/172 |
| 4,605,069 | 8/1986 | McClaflin et al. | 166/370 |

*Primary Examiner*—Stephen J. Novosad
*Assistant Examiner*—Bruce M. Kisliuk
*Attorney, Agent, or Firm*—G. Turner Moller

[57] ABSTRACT

A hydrocarbon producing well is worked over by wire line tools only to run a jet pump into the tubing string by perforating the tubing string and then isolating the perforation to direct power fluid injected down the annulus to pass into the power fluid inlet of the jet pump. Formation fluids delivered up the tubing string pass through the jet pump to the surface. The jet pump is placed in the well without tripping the tubing string and consequently without having to use a workover rig.

7 Claims, 7 Drawing Figures

OIL OR GAS WELL WORKOVER TECHNIQUE

This invention relates to a method and apparatus for working over an oil or gas producing well to increase the production therefrom.

Usually, the best that an oil or gas well produces is the first day it is put on line. With the exception of a well that has not been produced enough to clean up from the effects of drilling mud and filtrate entering the reservoir, everything is down hill from the first day. There are a variety of reasons, depending on whether the well is an oil well or a gas well, what kind of reservoir rock it is producing from, whether the formation is a water driven or pressure depletion reservoir, whether the formation fluids are corrosive, paraffin loaded, scale depositing and the like.

Taking a well that initially flows oil as exemplary, the well flows for a while, the length of time depending on whether the reservoir is water driven or pressure depletion. Sooner or later, the well starts to make salt water. In the case of a water driven reservoir, the amount of salt water can be horrendous, e.g. 1000–2000 barrels/-day, and the amount of oil can be small. In the case of a pressure depletion reservoir, the amount of water is usually nominal. Because many reservoirs are partially water driven, one will see oil wells making water in all quantities and percentages.

Sooner or later, either because of water influx of pressure depletion, oil wells have to be artificially lifted. The standard technique is move in a work over rig, be sure the well is dead by pumping brine into the tubing, detaching the well head, installing a pumping tee, running a down hole sucker rod type pump into the tubing on the end of a sucker rod string and landing it in a seating nipple, rigging up a pump jack, and attaching the sucker rod string to the pump jack. The pump jack motor is then started and the well begins to pump. This procedure is not cheap. Depending on the depth of the well and the cost of equipment at the time, one can spend anywhere from $20,000 to $100,000 to put a well on the pump.

Gas wells are different. In a water driven gas producing reservoir, the well flows gas and perhaps some condensate but little or no water at well head flowing pressures that decline very little until one day, the well is full of water and dead. No amount of working the well in this producing zone will do any good.

Gas wells producing from pressure depletion reservoirs or reservoirs which are only partially water driven are quite different. The production history of a typical natural gas well of this type is that the formation pressure is initially sufficient to move gases existing in the formation as well as liquids existing in the formation into the well bore. The volume of produced gas is sufficient to provide an upward velocity in the production string to keep liquid droplets moving upwardly to move the down hole gaseous and liquid components upwardly through the production string to the surface. As the formation is depleted, the formation pressure decreases. After production has continued for some time, gas wells typically begin to produce a detectable quantity of water which is known to be liquid in the formation and which is normally quite saline. At the onset of salt water production, the well head pressure begins to drop at a fairly rapid rate which is merely a manifestation of the weight of the liquids in the production string since the formation pressure continues to decline at a rate which can be predicted from the quantity of formation fluids produced. Sooner or later, the formation pressure adjacent the well bore declines to a value which is insufficient to deliver a sufficient gas volume through the production string to produce or unload liquid components therein. Accordingly, these liquid components accumulate in the production string until the weight of the liquid column substantially balances the formation pressure adjacent the bore hole whereupon the well dies. The accumulation of formation liquids in the production string is typically attributable to a low linear velocity of fluids in the production string. It is generally believed that formation fluids must flow upwardly through a conventional sized tubing string at about 5–10 feet per second in order to propel liquid droplets upwardly through the tubing string against the effect of gravity.

As the pressure drop between the formation adjacent the bore hole and the well head declines, the gas volume delivered through the tubing string drops and the linear velocity of gas through the production string declines until liquids begin to accumulate in the production string. As liquids accumulate in the production string, the weight of the fluid column therein increases whereupon the pressure drop between the formation adjacent the bore hole and the well head declines. Thus, there is a self-defeating process operating to cease production. The technique initially used to bring such a well back on production is to drop a "soap" stick into the well to foam the liquids therein and thereby reduce the weight of the fluid column in the production string. By opening and closing the surface valves, a sizeable amount of water can be produced at the surface in the form of a foam which reduces the weight of the liquid column in the production string and allows gas to flow again. Another technique is to swab the production string and mechanically remove all or part of the water contained therein and place the well back on production. These two techniques are useful for some time to periodically unload liquids from the production string and thereby get the well back on line.

Sooner or later, these techniques fail, either because of the cost of swabbing the well or the inability to keep the well flowing for very long. Then, the present standard technique is to snub into the production string a much smaller diameter string of tubing. In a production string of $2\frac{7}{8}''$ OD tubing, one would probably snub into it a string of $1\frac{1}{2}''$ OD tubing. Into a production string of $2\frac{3}{8}''$ OD tubing, one would probably use 1" OD tubing. These smaller diameter tubing stings decrease the cross sectional area of the production string and thereby increase the upward velocity which keeps liquid droplets moving upwardly in the tubing rather than collecting in the bottom of the well. Other techniques have been proposed to keep gas wells flowing, such as installing a conventional down hole sucker rod type pump, a plunger lift type pump or as shown in U.S. Pat. Nos. 3,887,008 and 4,275,790.

One limitation on some of the techniques used to increase production of either oil or gas wells is the cost associated with using a work over rig. Thus, some efforts have been made to allow working over a well by the use of wire line tools operating inside the production string without the use of a work over rig. Another advantage to the use of wire line tools is that they operate through a lubricator which means that the well does not have to be killed. This avoids any damage or possibility of damage to the producing formation.

Other disclosures of some interest relating to this invention are found in U.S. Pat. Nos. 3,844,352; 3,873,238; 4,335,786 and 4,410,041.

The work over technique of this invention involves placing a jet pump into the production string of an oil or gas producing well and equipping the well to produce therethrough without the use of a work over rig, without killing the well and without pulling the tubing string from the well. As used herein, the term jet pump is intended to include a simple upwardly directed nozzle in the flow string as well as a more complex venturi type pump having a nozzle, throat and diffuser.

One limitation which might be thought to be serious is that a jet pump requires a compressor to deliver power gas thereto. In many situations, this is of no concern at all because a compressor is already used in conjunction with production of the well or other production on the lease.

After studying the well history and the production history, a decision is made where to place the jet pump. Usually, but not always, it is desirable to place the jet pump immediate above the packer. This position of the jet pump is effective to reduce, to the maximum extent possible, the hydrostatic back pressure against which the well is producing.

When the workover procedure starts, the well is shut in even if it is already dead by closing the valves in the tree. The tree is disassembled above the upper master valve to attach a lubricator immediately above and coaxial with the upper master valve. Preferably, but not necessarily, a check valve assembly is run into the well on a wire line through the lubricator and landed at a convenient location, such as a seating nipple on top of the packer. The check valve assembly allows fluid flow upwardly through the tubing string but prevents fluid flow downwardly therethrough. Thus, when the tubing string is perforated, liquids in the annulus cannot enter the tubing and then flow downwardly into the formation.

If the tubing string is to be perforated immediately above the packer, a Kinley type perforator is run into the well and set down on top of the check valve assembly, thereby activating the perforator. If the tubing string is to be perforated at a location substantially above the packer, a collar stop, such as a Type F collet made by Otis Engineering Corporation, is run into the well on a wire line through the lubricator and placed in a collar immediately below the location where it is desired to place the jet pump. A Kinley type perforator is run on a wire line through the lubricator into the well. When activated, perforators of this type drive a flow member through the wall of the tubing string to provide communication between the inside of the tubing string and the annulus between the tubing and casing strings. The flow member is analogous to a rivet and provides a passage therethrough. Preferably, the passage has therein a check valve allowing fluid flow from the annulus into the tubing string and preventing flow from the tubing string into the annulus. Perforators of this type are activated by sitting the perforator down on the collar stop and applying weight thereto. After driving the flow member through the wall of the tubing, the perforator is removed from the tubing string. Preferably, the tubing string is swabbed to remove from the well those liquids previously contained in the annulus.

A jet pump is assembled on the surface and run into the tubing string on a wire line through the lubricator. The jet pump includes a lower sealing section, an intermediate pump section and an upper section having sealing, running and setting functions. Preferably, the assembly comprises a modified Otis Type G Packoff Anchor having a pump section replacing the conventional spacer pipe or B section.

After the wire line and running tools are removed from the well, the well is placed back on production by injecting gas downwardly through the annulus between the casing and tubing strings. There is a very short period of clean up after the work over procedure of this invention because most of the liquid and debris previously in the annulus above the packer has already been swabbed from the well.

It is accordingly an object of this invention to provide a procedure for working over a well and placing in the well a jet pump without the use of a workover rig and without killing the well.

Another object of this invention is to provide a workover procedure for placing a well back on production with a minimum expenditure of time, effort and equipment.

Another object of this invention is to provide a worked over well using the equipment of this invention.

Other objects and advantages of this invention will become more fully apparent as this description proceeds, reference being made to the accompanying drawings and appended claims.

IN THE DRAWINGS

Figure 1:
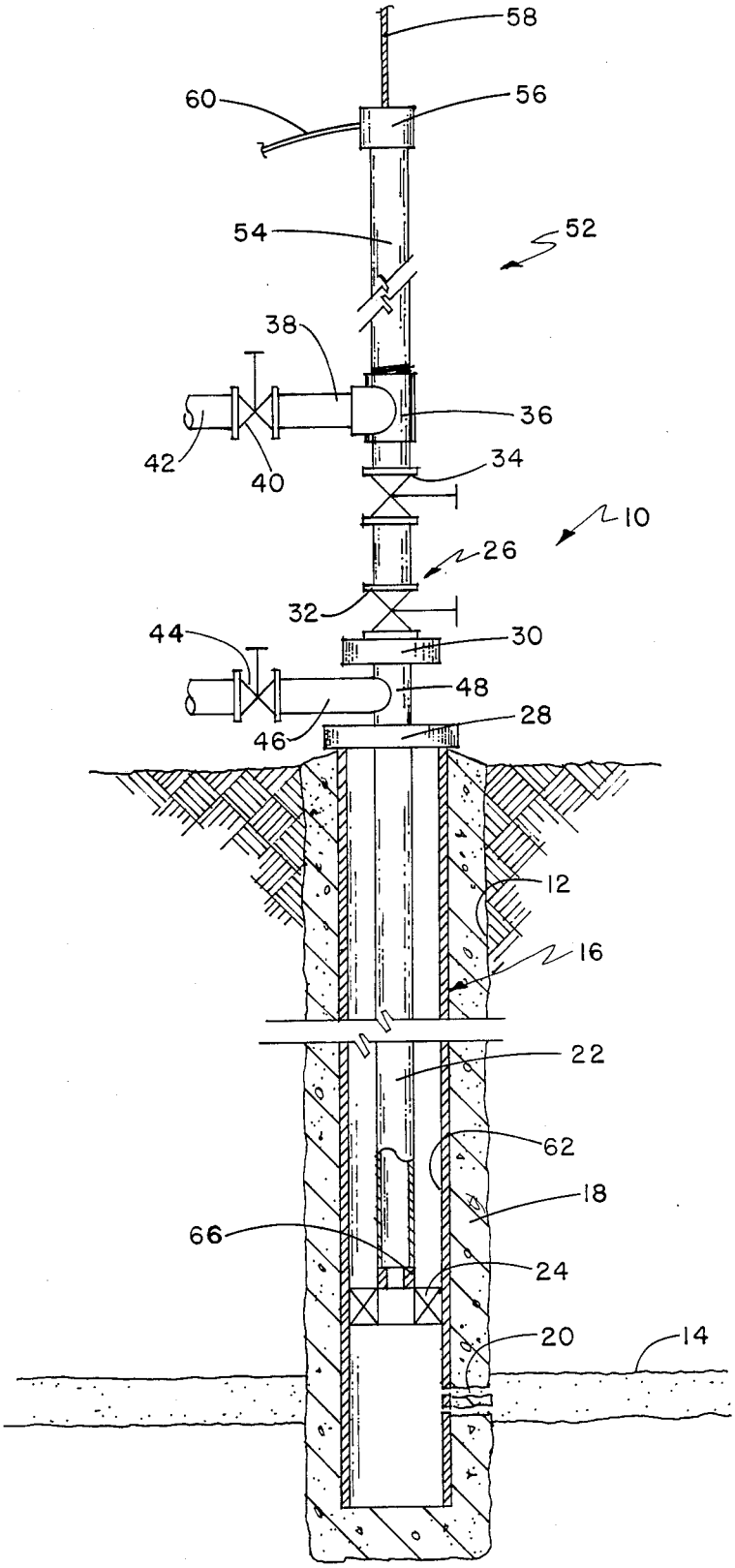
FIG. 1 is a vertical cross-sectional view through a well equipped to produce from a subterranean formation through the equipment of this invention.

Referring to FIG. 1, a well 10 comprises a bore hole 12 extending into the earth to a depth sufficient to penetrate a hydrocarbon bearing formation 14. A casing string 16 has been cemented in the bore hole 12 with a cement sheath 18 in a conventional manner. After the casing string 16 has been cemented in place, a conventional perforating gun (not shown) is used to provide a series of perforations 20 communicating between the formation 14 and the interior of the casing string 16. A tubing string 22 is run into the well 10 and includes a packer 24 adjacent the lower end thereof sealing between the tubing string 22 and the casing string 16. The tubing string 22 is illustrated as being wholly conventional and typically includes a series of joints having a threaded pin on one end and a threaded coupling on other.

At the surface, a tree 26 connects to the casing string 16 and includes a casing head 28, a tubing head 30 sealing between the casing string 16 and the tubing string 22, a lower master valve 32, an upper master valve 34, a tee 36 secured to the upper master valve 34 having a wing 38 leading to a wing valve 40 and a choke cage 42. A valve 44 and a nipple or conduit 46 communicate with a spool 48 between the casing and tubing heads 28, 30. The well 10 is thus equipped to flow through the tubing string 22 and choke cage 42. While the well 10 is flowing, a tapped bull plug (not shown) and pressure gauge (not shown) are connected to the upwardly facing threaded end of the tee 36. Those skilled in the art will recognize the well 10, as heretofore described, as typical of flowing oil or gas wells.

When the well 10 dies, or ceases flowing, a decision is made to work the well over to provide means for artificially lifting liquids from the bottom of the well. A decision is made where to land the jet pump of this invention, where to place a check valve assembly, if any, in the tubing string 22 prior to perforating the tubing and the like.

In conducting the work over procedure of this invention, the well 10 is first shut in, even if it is dead. This is accomplished by closing the wing valve 40 and the lower and upper master valves 32, 34. The tree 26 is partially disassembled by removing the bull plug (not shown) and pressure gauge (not shown) from the top of the tee 36.

A lubricator 52 is threadably attached to the upwardly facing box of the tee 36 and includes an elongate tubular compartment 54 having a combination threaded collar and wire line lubricating fitting 56 on the upper end thereof. The fitting 56 includes an expansible grease seal (not shown) therein for sealing against a wire line 58 when grease is pumped through a conduit 60. As will be recognized by those skilled in the art, the lubricator 52 allows wire line tools to be run into the well 10 under pressure without killing the well.

Figure 2:
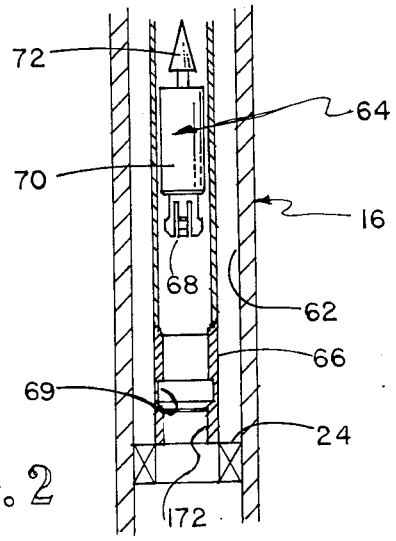
FIG. 2 is an enlarged cross-sectional view of the packer and seating nipple assembly of FIG. 1.

It is assumed that a decision has been made to isolate the producing formation 14 from any liquid contained in the annulus 62. To this end, a conventional standing or check valve assembly 64, such as is available from Otis Engineering, is run into the well 10 and landed in a seating nipple 66 threaded into the top of the packer 24, as shown best in FIG. 2. The check valve assembly 64 includes a lower collet type end 68 received and latched in the seating groove 69 of the seating nipple 66, a central valve body 70 and an upper fishing neck 72 so the assembly 64 can be readily retrieved. Almost all wells will have a seating nipple on top of the packer for two reasons. First, all seating nipples have a much smaller internal diameter than the tubing string which prevents swab cups from passing out of the lower end of the tubing and getting pulled off. Second, seating nipples are customarily run in oil wells, even if they are flowing because such wells will eventually have to be pumped and the downhole pump can be landed in the seating nipple without pulling the tubing. Thus, there is almost always a convenient place to land the check valve assembly 64. It will be seen that the standing or check valve assembly 64 allows fluid flow upwardly through the tubing string 22 and prevents flow downwardly through the packer 24 into the formation 14.

The next step in the procedure of this invention is to create a passage through the wall of the tubing string 22 to allow communication between the annulus 62 and the inside of the tubing string 22. Although this may be accomplished in several different manners, it is much preferred to use a Kinley type perfactor. Kinley type perforators are essentially downhole rivet guns which explosively drive a hardened metallic projectile through the tubing string. Because Kinley perforators are detonated by applying weight thereto, the first step in preparing to perforate the tubing string 22 is to provide something inside the tubing string to sit the perforator on. If the perforation in the tubing string is to be immediately above the packer 24, the Kinley perforator will be set on the fishing neck 72 of the standing valve 64.

Figure 3:
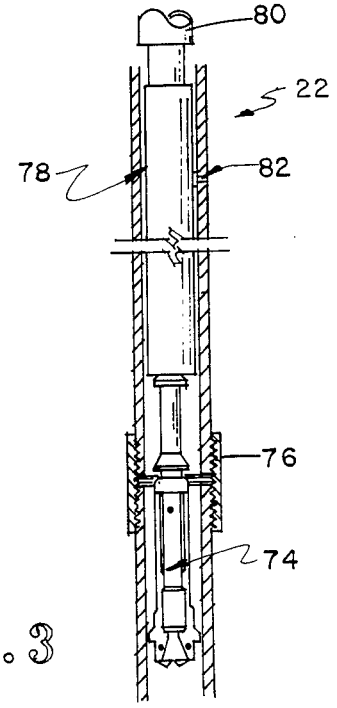
FIG. 3 is a schematic view of the perforating mechanism used to provide a passage through the tubing string of FIG. 1.

If the perforation in the tubing is be to substantially above the packer 24, there is run into the tubing string 22 a collar stop 74 shown in FIG. 3, such as a Type F Collet, Collar Stop available from Otis Engineering. In the event more information is needed related to the design, running and pulling of the collar stop 74, reference is made to a publication known as Type F Collet, Collar Stop Operating Instructions, dated 1970, available from Otis Engineering Corporation, Dallas, Tex.

Figure 4:
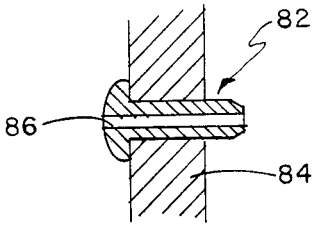
FIG. 4 is an enlarged cross-sectional view of a Kinley projectile providing a passage across the wall of the tubing string.

As shown in FIG. 3, the collar stop 74 will be latched into a collar 76 immediately below where it has been decided to perforate the tubing string 22 and, of course, above the standing valve 64. Although the well and production records of the well 10 will dictate, to some extent, where the perforation or perforations in the tubing string 22 will be located, typically the perforation is immediately above the first collar above the packer 24. The Kinley perforator 78, a weight bar (not shown) and other running tools 80 are placed inside the lubricator 52, and run into the tubing string 22 on the wire line 58. The perforator 78 is set on top of the collar stop 74. The weight of the weight bar is applied to the perforator 78 by relaxing the wire line 58. This causes the perforator 78 to fire a hardened metallic projectile 82 through the wall 84 of the tubing string 22 as shown best in FIG. 4. Kinley perforation projectiles are available in several types, the projectile 82 having a simple unobstructed passage 86 therethrough to communicate the annulus 62 with the inside of the tubing string 22.

Figure 5:
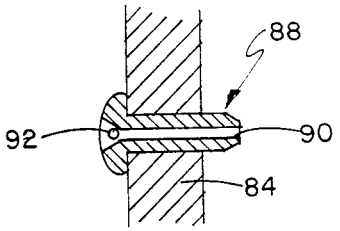
FIG. 5 is an enlarged cross-sectional view of another type Kinley projectile providing a passage across the wall of the tubing string.
Figure 6:
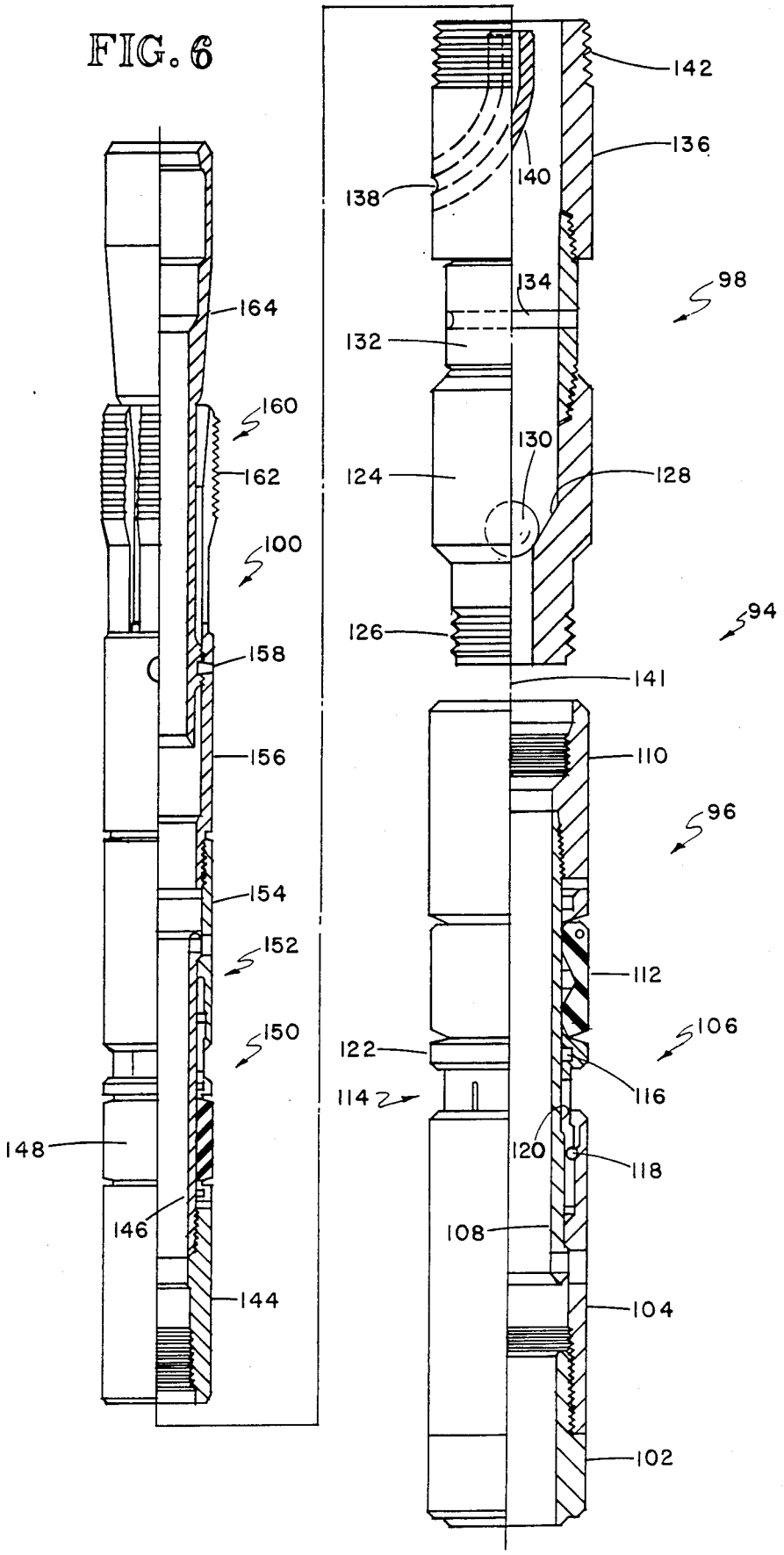
FIG. 6 is an enlarged view, partly in cross-section, of a string of tools used to place the jet pump of this invention in the well of FIG. 1.

The preferred Kinley projectile 88 is shown in FIG. 5 and includes a passage 90 therethrough having a check valve 92 preventing fluid passage from the tubing string 22 into the annulus 62 and allowing fluid flow from the annulus 62 into the tubing string 22. Suitable means (not shown) are provided to retain the check valve 92 in place in the projectile 88. This projectile is much preferred because, if the use of the jet pump of this invention is unsuccessful for some reason, it can be retrieved from the well 10 and the check valve 92 prevents formation fluids from moving up the annulus 62. Thus, when the assembly of this invention is removed, the well 10 is capable of being pumped or produced in the same manner that it was produced prior to the workover or recompletion attempt of this invention.

As soon as a passage is made in the wall 84 of the tubing string 22, any liquid in the annulus 62 is free to flow into the tubing string 22. After the Kinley perforator 78 and the collar stop 74 are removed from the tubing string 22, the tubing string 22 is swabbed with a conventional swab cup-swab line arrangement (not shown) to remove the liquid from inside the tubing string 22 and allow the annulus liquids to move into the tubing string 22. Swab runs are continued until the tubing string 22 is swabbed down to the check valve assembly 64. As the hydrostatic head in the tubing string 22 is reduced, some fluids from the formation 14 will begin to flow into the tubing string 22 so that both annulus liquids and formation fluids will be swabbed for a while. The purpose of swabbing the well 10 at this time is to remove the annulus liquids and prevent them from entering and damaging the formation 14. It is a simple matter to monitor the liquids coming out of the choke cage 42 to decide when to quit swabbing. The swab arrangement is then removed from the well 10 and lubricator 52 and the standing valve assembly 64 is removed from the seating nipple 66 and pulled out of the well 10. At this time, any liquids in the annulus have been removed without allowing them to flow into the producing formation 14.

If the perforation through the tubing string 22 is immediately above the packer 24, a collar stop 74 is then run into the well and landed in the seating nipple 66. On the other hand, if the perforation is substantially above the packer 24, either the same or another collar stop 74 is then run back into the well 10 and latched in the same collar 76 having the Kinley perforation 82 immediately thereabove.

In the event a decision is made to allow any liquid in the annulus 62 to flow downwardly toward the formation 14, it will be evident that the check valve assembly 64 is not run into the tubing string. It will also be evident that the collar stop 74 is run just once, i.e. prior to running the perforating mechanism 78. In this circumstance, it will be seen more clearly that the use of the collar stop 74 locates the projectile 82 or 88 a predetermined distance above the collar stop 74. Thus, when the pump assembly 94 is run into the tubing string 22, the seals thereof are located above and below the perforations.

Next, the pump assembly 94 of this invention, along with running tools (not shown) such as an Otis Type 'GS' Running/Pulling Tool, jars (not shown) and a weight bar (not shown) are placed in the lubricator 52 and run into the tubing string 22. The assembly 94 of this invention comprises, as major components, a lower pack off anchor 96, a central pump section 98 and an upper pack off anchor 100. The lower pack off anchor 96 may be of any suitable type and is illustrated as comprising a slightly modified lower pack off anchor from a Type G Pack Off Anchor made by Otis Engineering. The conventional Otis Type G lower pack off anchor is modified merely by cutting the collets off the lower end thereof so the anchor 96 will sit flat on the top of the conventional Type F collar stop 74.

The lower pack off anchor 96 accordingly comprises a lower externally threaded sleeve 102 threadably received in the lower end of shiftable sleeve 104 comprising part of a seal expander 106. The seal expander 106 also includes an internal sleeve 108 threaded into a collar 110 comprising the upper end of the lower pack off anchor 96. A conventional annular rubber seal 112 is mounted on the exterior of the sleeve 108 and abuts the collar 110 at the juncture thereof. The lower end of the seal 112 abuts a split ring assembly 114 having an O-ring seal 116 sealing against the exterior of the sleeve 108. The seal expander 106 includes a series of ball detents 118 carried between the upper end of the sleeve 104 and the central recessed section 120 of the sleeve 108. As will be apparent to those skilled in the art, the application of weight to the collar 110 causes the sleeve 108 to move downwardly relative to the sleeve 104 and the ball detents 118 move into the recessed section 120 until the ring 122 of the split ring 114 bottoms out on the upper end of the sleeve 104. This causes the seal 112 to expand into sealing engagement with the inside of the tubing string 22.

The central pump section 98 of the assembly 94 comprises a replacement for the "B" section of the conventional Otis Type G Pack Off Anchor and includes a check valve body 124 having a lower threaded end 126 received in the top of the collar 110. The check valve body 124 includes an upwardly facing beveled seating surface 128 receiving a ball check 130. A nipple 132 having a rod 134 or other ball retaining means therein is threaded into the top of the valve body 124.

The nipple 132 threads into the bottom of a pump barrel 136 having a power fluid opening 138 in the side thereof. The opening 138 communicates with a nozzle 140 having an outlet section on the axis 141 of the pump section 98. The upper end 142 of the pump barrel 136 is threaded to connect to the lower end of the upper pack off anchor 100. Although the pump section 98 is illustrated as including a simple jet nozzle, it will be evident that more sophisticated venturi arrangements are equally applicable to this invention.

The upper pack off anchor 100 is conveniently identical to the upper pack off anchor of the Otis Type G Pack Off Anchor and is accordingly described only briefly. In the event more information is needed concerning the upper pack off anchor 100 or the lower pack off anchor 96, reference is made to the Type G Pack-Off Anchor Operating Instruction, dated 1970, of Otis Engineering Corporation, Dallas, Tex. Briefly, the upper pack off anchor 100 includes a lower collar 144 threadably receiving a lower sleeve 146 having a seal 148 thereon. The seal 148 is deformed by an expander 150 similar to the expander 106. A sleeve assembly 152 includes a lower sleeve 154 comprising part of the expander 150 having the upper end thereof threaded onto an upper sleeve 156. A shear pin 158 connects the upper sleeve 156 to a slip assembly 160 including a plurality of slip elements 162 movable radially relative to the axis 141 by a conically shaped expander 164. The upper end of the expander 164 releasably connects to the end of the Otis Type 'GS' Running/Pulling Tool.

When the assembly 94 of this invention is run into the tubing string 22 it ultimately sits down on top of the collar stop 74 immediately below the Kinley projectile 82. Applying the weight of the weight bar to the Otis Type 'GS' Running/Pulling Tool causes the seal expanders 106, 150 to deform the seals 112, 148 into sealing engagement with the interior of the tubing string 22 below and above the kinley projectile 82, 88 thereby isolating the tubing passage 86, 90 and directing any fluid flowing therethrough into the power fluid inlet 138. Jarring down on the Otis Type 'GS' Running/Pulling Tool causes the shear pin 158 to fail thereby releasing the expander 164 for relative movement downwardly into the upper sleeve 156 thereby setting the slips 162 against the inside of the tubing string 22.

The Otis Type 'GS' Running/Pulling Tool is then detached from the expander 164 and the wire line tools are withdrawn from the tubing string 22 into the lubricator 52. The upper and lower master valves 34, 32 are then closed, the lubricator 52 removed from the tree 26 and the bull plug and pressure gauge (not shown) are then reattached to the upper end of the tee 36. The well 10 is then ready to be put back on production.

To this end, relatively high pressure gas is delivered. through the casing valve 44 and flows downwardly through the annulus 62 and passes through either of the openings 86, 90 into the tubing string 22. The assembly 94 directs the power fluid to the power fluid inlet 138 and it passes through the nozzle 149. Fluids from the formation 14 pass upwardly through the packer 24 and into the inlet or bottom end 102 of the lower pack off anchor 96. The formation fluids move upwardly through the assembly 94 and ultimately enter the pump barrel 142 where they become entrained with the power fluid and pass upwardly through the tubing string 22 to the surface.

At the surface, a mixed stream of power and formation fluids exit through the wing valve 40 into suitable production equipment where oil, gas and water are separated. Some of the gas is compressed as the power fluid and reinjected into the casing valve 44. The oil is stored and ultimately sold. The water is stored and ultimately disposed of.

Figure 7:
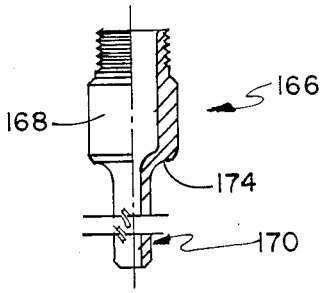
FIG. 7 is a schematic view of another feature of this invention.

Referring to FIG. 7, there is illustrated another feature of this invention. In the previous embodiment, the lower end of the collar 102 comprises the inlet of the pump assembly 94 and sits on top of the collar stop 74. In the embodiment of FIG. 7, a collar 166 replaces the collar 102 and comprises a collar body 168 threaded into the lower end of the sleeve 104 and a stinger 170 which extends downwardly through the opening in the packer 24. Thus, the pump assembly 94 can pump from a level below the packer 24. The embodiment of FIG. 7 cannot sit on top of the collar stop 74 because the stinger 170 cannot pass therethrough. Thus, in the embodiment of FIG. 7, the stinger 170 is sized to pass through the central passage 172 of the seating nipple 66 while the shoulder 174 of the collar 166 sits on top of the seating nipple 66 so that the pump assembly sits on top of the seating nipple 66. To form the passageway across the tubing string 22 for use with the embodiment of FIG. 7, the perforating mechanism 78 may be detonated by sitting it on top of the seating nipple 66 or by sitting it on top of a stop latched into the seating nipple 66.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A method of working over a well producing from a subterranean formation and having a casing string cemented in a well bore penetrating the formation, a tubing string inside the casing string and a packer sealing between the tubing string and the casing string, comprising running into the tubing string a perforating mechanism and creating a passageway across the tubing string into the inside of the casing string by driving a member through the tubing string, the member having a passage therethrough having a check valve therein and comprising the steps of preventing fluid flow from the inside of the tubing string into the annulus between the tubing string and the casing string and allowing fluid flow into the tubing string from the annulus and then removing the perforating mechanism from the tubing string;

running into the tubing string, on a wire line, a jet pump assembly having a lower suction inlet, an upper discharge outlet and a power fluid inlet between the suction inlet and the discharge outlet, first seal means above the power fluid inlet and second seal means below the power fluid inlet;

manipulating the wire line and activating the first and second seal means for sealing against the inside of the tubing string above and below the passageway; and placing the well back on production by injecting a power fluid downwardly into the well, passing the power fluid through the passageway across the tubing string into the power fluid inlet and delivering liquids from the formation upwardly through the well.

2. The method of claim 1 wherein the passing step comprises passing the power fluid downwardly between the casing string and the tubing string and the delivering step comprises delivering liquid from the formation upwardly through the tubing string.

3. The method of claim 1 further comprising, before running the perforating arrangement into the well, the step of running into the tubing string a check valve assembly allowing fluid flow upwardly through the tubing string and preventing fluid flow downwardly through the tubing string and landing the check valve assembly at a first location, and wherein the passageway creating step comprises creating a passageway in the tubing string at a second location above the first location.

4. The method of claim 3 further comprising the step of swabbing the tubing string after creating the passageway therein for removing liquids between the casing string and the tubing string.

5. The method of claim 1 wherein the well comprises a tree at the surface connected to the casing string and the tubing string for sealing therebetween, the tree including a valve coaxial with the tubing string and a threaded connection coaxial with the valve, and further comprising the step of attaching a lubricator to the threaded connection and wherein the running steps comprise separately placing the perforating mechanism and the jet pump arrangement in the lubricator with the valve closed, and then opening the valve and allowing the perforating mechanism and the jet pump arrangement to fall into the tubing string.

6. The method of claim 1 wherein the tubing string comprises a series of joints having collars connecting the joints together and further comprising the step of running a collar stop into the tubing string and latching the collar stop into a selected one of the collars of the tubing string, and wherein the step of running the perforating mechanism into the tubing string comprises setting the perforating mechanism on the collar stop and then detonating the perforating mechanism and thereby locating the passageway a predetermined distance above the collar stop.

7. The method of claim 6 wherein the step of running the jet pump assembly into the tubing string comprises setting the jet pump assembly on the collar stop and thereby locating the passageway between the first and second seal means.

* * * * *